US007387298B2

(12) United States Patent
Lapointe

(10) Patent No.: US 7,387,298 B2
(45) Date of Patent: Jun. 17, 2008

(54) SYNCHRONIZED VACUUM BELT FEEDER

(75) Inventor: Andre Lapointe, Saint-Georges-de-Beauce (CA)

(73) Assignee: OSI Machinerie Inc., Quebec (CA)

( * ) Notice: Subject to any disclaimer, the term of this patent is extended or adjusted under 35 U.S.C. 154(b) by 255 days.

(21) Appl. No.: 11/271,547

(22) Filed: Nov. 9, 2005

(65) Prior Publication Data

US 2006/0181005 A1 Aug. 17, 2006

Related U.S. Application Data

(60) Provisional application No. 60/626,872, filed on Nov. 12, 2004.

(51) Int. Cl.
*B65H 29/24* (2006.01)

(52) U.S. Cl. ..... 271/194; 271/196; 271/197

(58) Field of Classification Search ..... 271/194, 271/196, 197; 198/678.1, 689.1, 867.03, 198/803.5
See application file for complete search history.

(56) References Cited

U.S. PATENT DOCUMENTS

| | | | | |
|---|---|---|---|---|
| 1,634,196 | A * | 6/1927 | Jones | 144/242.1 |
| 3,682,469 | A * | 8/1972 | Itoh et al. | 271/12 |
| 3,908,835 | A * | 9/1975 | Lubas | 414/793.1 |
| 4,442,657 | A | 4/1984 | Busseniers et al. | |
| 6,793,217 | B2 * | 9/2004 | Grønbjerg | 271/197 |
| 2003/0164587 | A1 * | 9/2003 | Gronbjerg | 271/197 |

* cited by examiner

*Primary Examiner*—David H Bollinger
(74) *Attorney, Agent, or Firm*—Wells St. John P.S.

(57) ABSTRACT

A vacuum belt feeder comprising a means of conveyance having a pitch, for retrieving items from a supply zone, and then distributing them at target locations in a discharge zone.

1 Claim, 2 Drawing Sheets

SYNCHRONIZED VACUUM BELT FEEDER

CROSS REFERENCE TO RELATED APPLICATIONS

This application claims priority on U.S. provisional application No. 60/626,872, filed on Nov. 12, 2004. All documents above are herein incorporated by reference.

FIELD OF THE INVENTION

The present invention relates to item transfer. More specifically, the present invention is concerned with a synchronized vacuum belt feeder.

BACKGROUND OF THE INVENTION

A number of manufacturing processes need, at some point thereof, transferring items from a supply zone to a discharge zone.

In the food industry, vacuum belt feeders are used from ovens to containers for retrieving baked goods still in baking moulds and conveying them, while at some point along the way dropping the baked goods from the moulds. A means of suction actuated by vacuum is used on the vacuum belt feeders, which allows the moulds to adhere to the conveyor and then dropping them for example.

However, in cases where the transferred items must be sorted out in relation to classification criteria, it is not sufficient that the items be conveyed then dropped. They must also be dropped at target locations, which requires that the vacuum belt feeders be synchronized. For example, in a wood floor manufacturing line, boards processed by a tenoner are conveyed to a wood grader. It may be contemplated using mechanical setups or automated handling to feed the grader. However, such solutions usually involve complex installations, as well as expensive monitoring and maintenance.

There is therefore a need in the art for a synchronized vacuum belt feeder.

SUMMARY OF THE INVENTION

More specifically, there is provided a vacuum belt feeder for transferring items from a supply zone to a discharge zone, comprising a means of conveyance provided with suction heads connected to vacuum chambers, the suction heads being continuously actuated under vacuum, wherein pickup of the items in the supply zone and release of the items at target locations in the discharge zone by the vacuum belt feeder are synchronized by a pitch of the means of conveyance.

Other objects, advantages and features of the present invention will become more apparent upon reading of the following non-restrictive description of embodiments thereof, given by way of example only with reference to the accompanying drawings.

DESCRIPTION OF EMBODIMENTS OF THE INVENTION

The present invention will now be described, for illustrative purposes only, in relation to the wood floor manufacturing industry, although it may be used in other fields, as will become more apparent upon reading the following.

Figure 1:
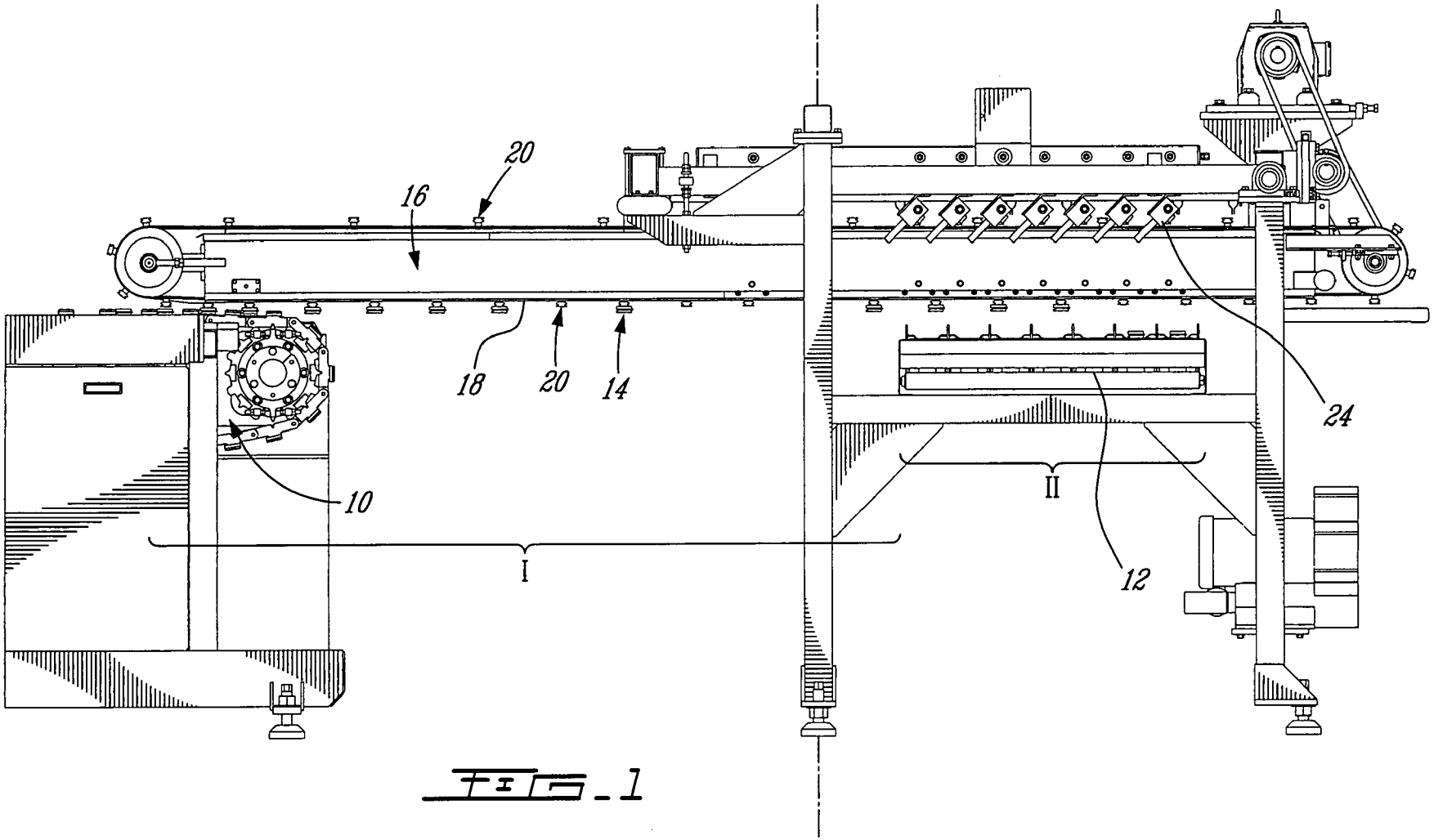
FIG. 1 is a schematic view of a system using a vacuum belt feeder according to an embodiment of the present invention.

As illustrated in FIG. 1 of the appended drawings, for exemplary purposes only, a wood floor manufacturing system generally comprises a tenoner 10 and conveyor units 16 and 12 to a wood grader (not shown). The tenoner 10 generally machinates boards 14. At the output of the tenoner 10, the conveyor unit 16 conveys the items 14 from the tenoner 10 to the conveyor unit 12 leading to the wood grader.

According to the present invention, the conveyor unit 16 located between the tenoner 10 and the conveyor unit 12 is a vacuum belt feeder. The vacuum belt feeder 16 generally comprises a suction zone (I), wherein the items 14 are retrieved from the tenoner 10, and a discharge zone (II) wherein the items 14 are released and placed on the conveyor unit 12.

Figure 2:
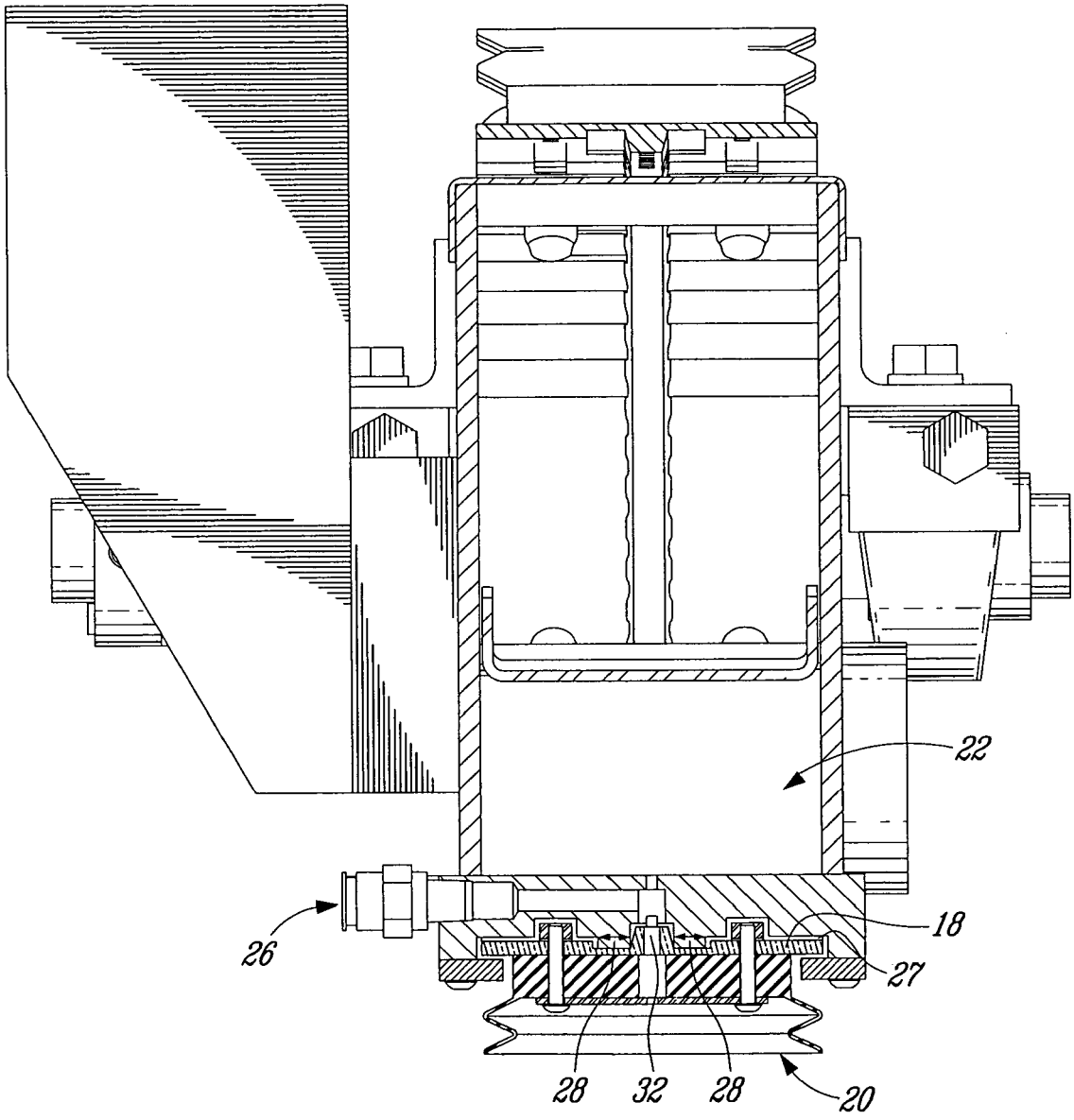
FIG. 2 is a closeup cross-section view of a suction head in the vacuum belt feeder used in the system of FIG. 1.

The vacuum belt feeder 16 comprises a means of conveyance 18 provided with suction heads 20 connected to vacuum chambers 22 through vacuum holes (see FIG. 2). The suction heads 20 are fastened to the belt of the means of conveyance 18, as illustrated in FIG. 2 for example. They are continuously actuated under vacuum, except at predetermined locations in the discharge zone (II) where valves 24 are actuated so as to let air 26 through the vacuum holes to cancel the vacuum so as to release the items 14 at target locations in the discharge zone (II), on the conveyor unit 12. Traps actuated by a cylinder may be used instead of valves, but valves are found to provide an enhanced vacuum imperviousness.

The belt of the means of conveyance 18 is provided with a pitch, thereby ensuring that the vacuum belt feeder 16 be synchronized in such a way as to allow retrieving the items 14 at the output of the tenoner 10, and release them in the discharge zone (II) to place them on target conveyor parts of the conveyor unit 12.

As best seen in FIG. 2, the belt of the means of conveyance 18 may be a cogged belt, wherein each cog 27 is cut so as to provide at least one plane surface 28, allowing accommodation of a seal between the suction head 20 and the associated vacuum chamber 22, thereby allowing operation of vacuum actuation from outside. The cogged belt may be equipped with guiding lugs 32.

As an alternative to a cogged belt with sealing surfaces, the means of conveyance 18 may comprise a chain with links allowing a mechanical seal between each suction head and associated vacuum chamber, or a flat belt perforated with holes and inherently provided with sealing surfaces (not shown).

All parts of the vacuum belt feeder 16 in the suction zone (I) operate simultaneously at a given speed, the vacuum actuating the suction heads 20 being canceled simultaneously to release a given piece 14 in a target location in the discharge zone (II) on the conveyor unit 12.

A presorting step may be achieved at the output of the tenoner, for example by means of a scanner determining the grade of each delivered board to determine on which conveyor part of the conveyor unit 12 a given wood piece is to be dropped. Alternatively, an operator may visually pre-sort the items delivered by the tenoner 10 and direct them. In absence of such a pre-sorting step, all items of wood are delivered to the conveyor unit 12, the items being distributed among the different conveyor parts of the conveyor unit 12 to allow operators attending each conveyor part of the conveyor unit 12 to work at a same pace. In any case, synchronization is required since the boards need to be dropped among the different conveyor parts of the conveyor unit 12.

In a wood floor manufacturing line, the vacuum belt feeder as described hereinabove allows processing up to 300 boards per minute, in a continuous manner, without resorting to mechanical movements, resulting in a system that is cost effective as well as easy to monitor and maintain.

The present invention provides precision and speed of operation at controlled costs, compactness, and ease of maintenance. It also provides the control to handle the boards from the tenoner to the discharge zone (II), as illustrated herein.

Although the present invention has been described hereinabove by way of embodiments thereof, it may be modified, without departing from the nature and teachings of the subject invention as defined in the appended claims.

What is claimed is:

1. A vacuum belt feeder for transferring items from a supply zone to a discharge zone, comprising a cogged belt provided with suction heads connected to vacuum chambers, said suction heads being continuously actuated under vacuum, each cog of said cogged belt providing at least one plane surface for accommodation of a seal between each suction head and an associated vacuum chamber, thereby allowing operation of vacuum actuation from outside, wherein pickup of the items in the supply zone and release of the items at target locations in the discharge zone, by said vacuum belt feeder are discharge zone synchronized by a pitch of said belt.

* * * * *